US006131591A

United States Patent [19]

Hollah

[11] Patent Number: 6,131,591

[45] Date of Patent: Oct. 17, 2000

[54] SUN PROTECTION MEANS

[76] Inventor: Engelbert Hollah, Lindenallee 12, 49214 Bad Rothenfelde, Germany

[21] Appl. No.: 09/214,203

[22] PCT Filed: Jul. 4, 1997

[86] PCT No.: PCT/EP97/03547

§ 371 Date: Dec. 30, 1998

§ 102(e) Date: Dec. 30, 1998

[87] PCT Pub. No.: WO98/01052

PCT Pub. Date: Jan. 15, 1998

[30] Foreign Application Priority Data

Jul. 6, 1996 [DE] Germany ..... 19627293
Feb. 28, 1997 [DE] Germany ..... 19708174

[51] Int. Cl.[7] ..... A45B 25/18

[52] U.S. Cl. ..... 135/33.2; 135/33.7

[58] Field of Search ..... 135/33.2, 33.7, 135/15.1, 16

[56] References Cited

U.S. PATENT DOCUMENTS

| | | | |
|---|---|---|---|
| 2,756,760 | 7/1956 | Grotteria | 135/33.2 |
| 4,804,008 | 2/1989 | Ryfer | 135/33.2 |
| 5,487,401 | 1/1996 | Johnson | 135/33.2 |
| 5,640,984 | 6/1997 | Dubunsky | 135/33.2 |
| 5,678,586 | 10/1997 | Baksh | 135/33.2 |
| 5,890,506 | 4/1999 | Kupferman | 135/33.2 |

*Primary Examiner*—Beth A. Stephan
*Attorney, Agent, or Firm*—Jordan and Hamburg LLP

[57] ABSTRACT

A flexible, two-dimensional sunshade for the absorption and/or reflection of sunlight, especially of UV light, especially for mounting as a sun umbrella, awning or window shade, the sunshade, having regions interspersed by a pattern of light windows, being configured so that the regions form a regular, geometric pattern of light windows and barrier regions, adjacent light windows as well as adjacent barrier regions in each case adjoining one another in corner regions.

26 Claims, 7 Drawing Sheets

SUN PROTECTION MEANS

BACKGROUND OF THE INVENTION

The invention relates to a flexible, two-dimensional sunshade.

Usually, a sunshade, particularly a protection against UV light, constructed as a sun umbrella, an awning or a window shade, is constructed from a textile or sheet-like material, which occupies its surface. On the side averted from sun radiation, such a sunshade forms a continuous shadow region. Any tanning of the skin, which may be desirable, is hardly possible in this shadow region.

In order, nevertheless, to make tanning possible even under the sunshade, the German Offenlegungsschrift 23 36 665 discloses a sun umbrella, which has scattered light windows, through which a certain part of the light can pass, the light windows being formed as holes, stamped out of the textile material of the umbrella. This arrangement, however, has the disadvantage that the individual perforations in the textile material can tear out or, in order to avoid this, have to be seamed individually, which makes the manufacturing costs considerably more expensive.

The German Offenlegungsschrift 22 14 622 additionally discloses the possibility of forming a sunshade of the type named above as a net, the meshes of the net representing the light windows and the light transmissibility therefore being determined by the mesh width. Such a gauze-like material will not, however, be able to have sufficient stability to form a sunshade of large area. The possibility, also given in this publication, of forming the light windows by perforating a two dimensional fabric, has the same problems that have already been mentioned in the German Offenlegungsschrift 23 36 655.

From the German Utility Patent 71 26 269, it is furthermore known that either the whole of the sunshade areas or the areas of light windows may be covered by a transparent, wavelength-sensitive sheet, in order to be able to filter out therewith partial ranges of the light spectrum striking the sunshade. In the case of such a closing of the light windows with a transparent film, however, passage of air through these light windows is prevented, so that heat can accumulate under the sunshade. Moreover, when individual light windows are covered, the formation of the sunshade from a textile material, for manufacturing reasons, is precluded or associated with considerable additional expense.

SUMMARY OF THE INVENTION

The invention is therefore based on the problem of creating a mechanically stable sunshade, which can be produced cost-effectively and is suitable for as uniform as possible a passage of light.

Due to the construction of a regular, geometric pattern of light windows and barrier regions, in which adjacent light windows or adjacent barrier regions adjoin one another at least in their corner regions, a sunshade is formed, which enables the symmetrical passage of light and, at the same time, makes a mechanically stable construction possible.

For the symmetrical passage of light, it is particularly advantageous if about 50% of the sunshade area is constructed as light windows, individual barrier regions and light windows in each case supplementing one another into a square, so that the sunshade can be built up from a regular continuation of such squares. For this purpose, the barrier regions and the light windows are constructed geometrically similarly as isosceles and right-angled triangles, which adjoin one another along their hypotenuses and, by these means, in each case form the basic unit of a square.

These individual squares are adjacent in such a manner, that the corner of a light window, contained by legs of equal length, is opposite a similar corner of a further light window; the barrier regions are also disposed similarly, As a result, an alternation of the triangular orientation arises between adjacent squares, so that, independently of the direction of the incident light, it is always ensured that shadow or light strips are not formed on areas protected by the sunshade, that the sunshade does not have a preferred direction and that a uniform exposure of the protected areas is guaranteed.

It is particularly advantageous if a network, which guarantees the mechanical stabilization of the sunshade, is incorporated in the edge regions of the light windows or barrier regions. Said network may be formed, for example, by polypropylene yarns. The network then divides the sunshade into uniform, geometric, partial segments. If the bearing yarns of the network cross one another at right angles, these partial segments are formed as rectangles or squares.

If these partial segments form squares, these squares in each case can take up a light window and a complementary barrier region, each of which is constructed as a triangle in the manner described above.

From a weaving point of view, it is to be preferred if diagonal yarns do not have to be incorporated and if instead the triangular shapes of the light windows or barrier regions are formed only approximately by approximating rectangular surfaces.

For this purpose, the partial segments of the network advantageously are traversed by warp and filling yarns of a woven composite and divided into smaller area units, half of these area units, by being covered with a yarn material, forming a barrier region and the other half of these area units remaining as light windows. By suitably filling the area units, the above-described triangular pattern, which is portrayed as particularly advantageous for the uniform passage of light, is realized approximately.

The migrational movement of the shadow, resulting from the rotation of the earth, is taken into consideration advantageously in such a manner, than an area, protected by the sunshade, is divided into shadow and light regions, an alternation between shadow and light regions taking place after a few minutes.

Excessive exposure to UV light of individual parts of the body of a person protected by the sunshade is reliably avoided in this manner. However, due to the constant alternation of light and shadow regions, tanning remains possible. At the same time, by adapting the size of the light window to the migrational movement of the shadow, the formation of a tanning pattern on the skin is prevented.

If the light windows are constructed as material recesses, an accumulation of heat under the sunshade is reliably avoided because of the air permeability. Moreover, the surface area of the sunshade, which can be attacked by wind, is decreased.

Such a sunshade can cover large areas, such as an outdoor café, in one piece. In this case, the decreased surface area, which can be attacked by wind, is particularly advantageous.

Further advantages arise out of the drawing as well as from the following description of several examples of the object of the invention.

IN THE DRAWINGS

FIG. 1 shows a one-piece covering of a sun umbrella with a uniform triangular pattern, FIG. 2 shows a sun umbrella of FIG. 1 in use, FIG. 3 shows a representation of a sun umbrella, similar to that of FIG. 2, with a continuous variation in the size of the light windows, FIG. 4 shows a section of a sunshade, traversed by a network, with an approximately triangular pattern of FIG. 1, FIG. 5 shows a pattern corresponding to that of FIG. 1, within a partially closed sunshade, FIG. 6 shows a pattern with regions of light windows of different size and FIG. 7 shows an alternative pattern of light windows in a sunshade.

DESCRIPTION OF THE PREFERRED EMBODIMENTS

In particular, the sunshade 1 has regions 2, which are interspersed by light windows 3, about 50% of the area of the sunshade 1 being constructed in these regions 2 as light windows 3.

In this connection, either the whole of the sunshade 1 can be interspersed by light windows 3 or individual partial regions 2 of the sunshade 1 can be provided with the light windows 3.

The sunshade 1 can be produced from different materials, such as textile material or plastic sheets. Moreover, the sunshade 1 may have a metallic coating, in order to affect thereby the reflective and absorptive behavior of the sunshade 1.

Figure 6:
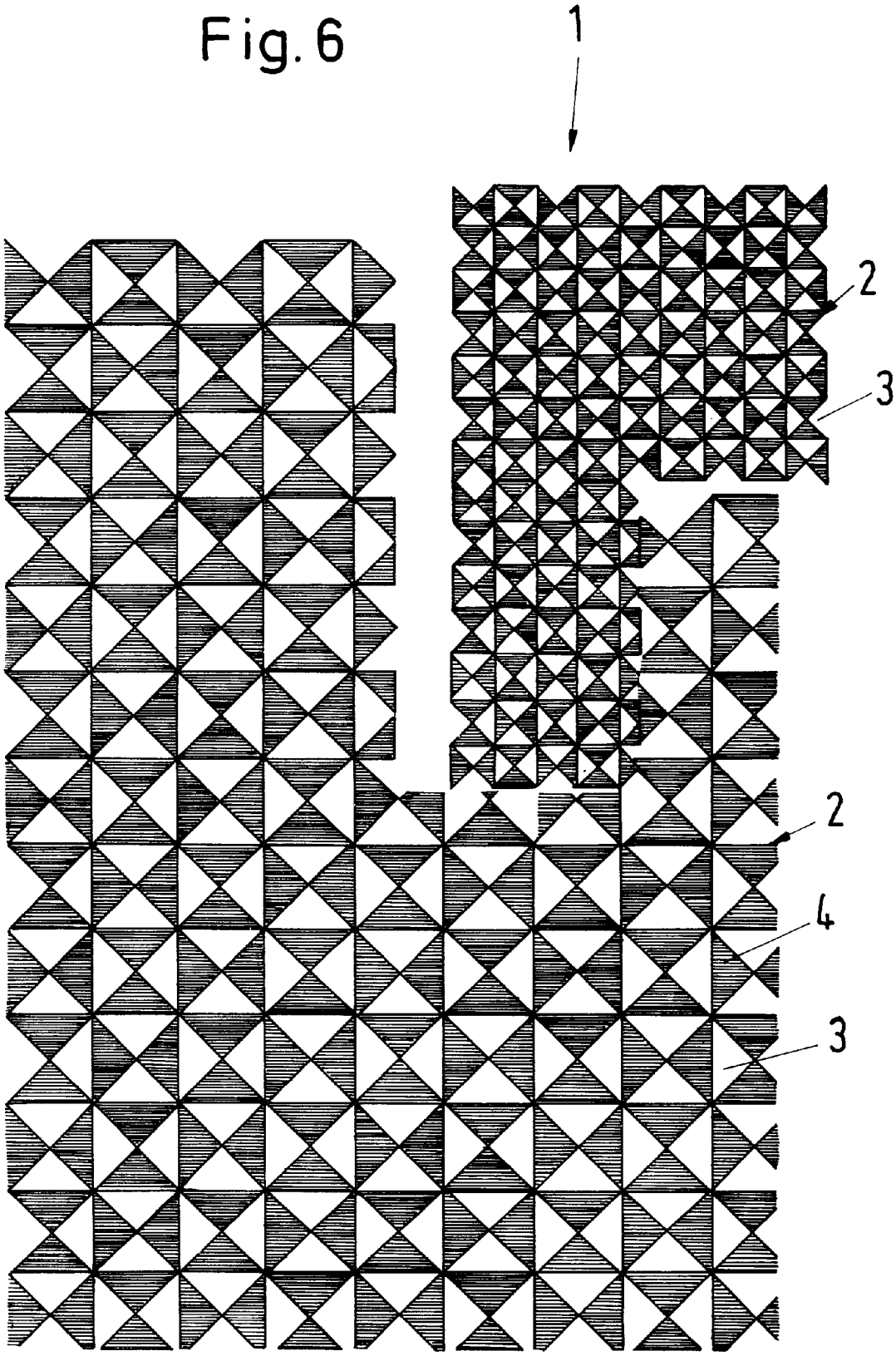

In order to bring about as uniform a tanning as possible of a person, protected by the inventive sunshade 1, while simultaneously minimizing the danger of a sunburn, a region, exposed to light, should change over into a shadow region about every 10 minutes. This can be attained by adapting the dimensions of the light windows 3 to the rate of migration, which results from the rotation of the earth, of the shadow formed by the sunshade 1. In this connection, it is possible (FIGS. 6 and 7) to provide light windows 3 of different sizes in one sunshade 1.

When a sunshade is mounted at a height, for example, of one meter, the rate of migration of the shadow, caused by the sunshade 1, is about 50 cm per hour, so that, if it is desired to alternate between shadow regions and the regions exposed to light after about 10 minutes, the dimensions of the light windows 3 must lie within he range of a few centimeters.

The light windows 3 are disposed in a regular sequence, which forms a geometric pattern. In this connection, adjacent light windows 3 and adjacent barrier regions 4 in each case adjoin one another in their corner regions 4.

The sequence should be constructed in such a manner that no light strips or shade strips are formed at the area, protected by the sunshade 1, in order to make a uniform shading and exposure of this area possible by these means. This should be the case for every orientation of the sunshade and every position of the sun, in order to avoid the need for additional adjustment of the sunshade 1 by the user.

A geometric, triangular pattern is particularly advantageous. By the differently rotated triangular shapes of the light windows 3 and the barrier regions 4 in FIGS. 1 to 4, it turns out hat, for each orientation relative to the sun, a uniform exposure and shading of the area, protected by the sunshade 1, that is, for example, of a person, is made possible.

Figure 1:
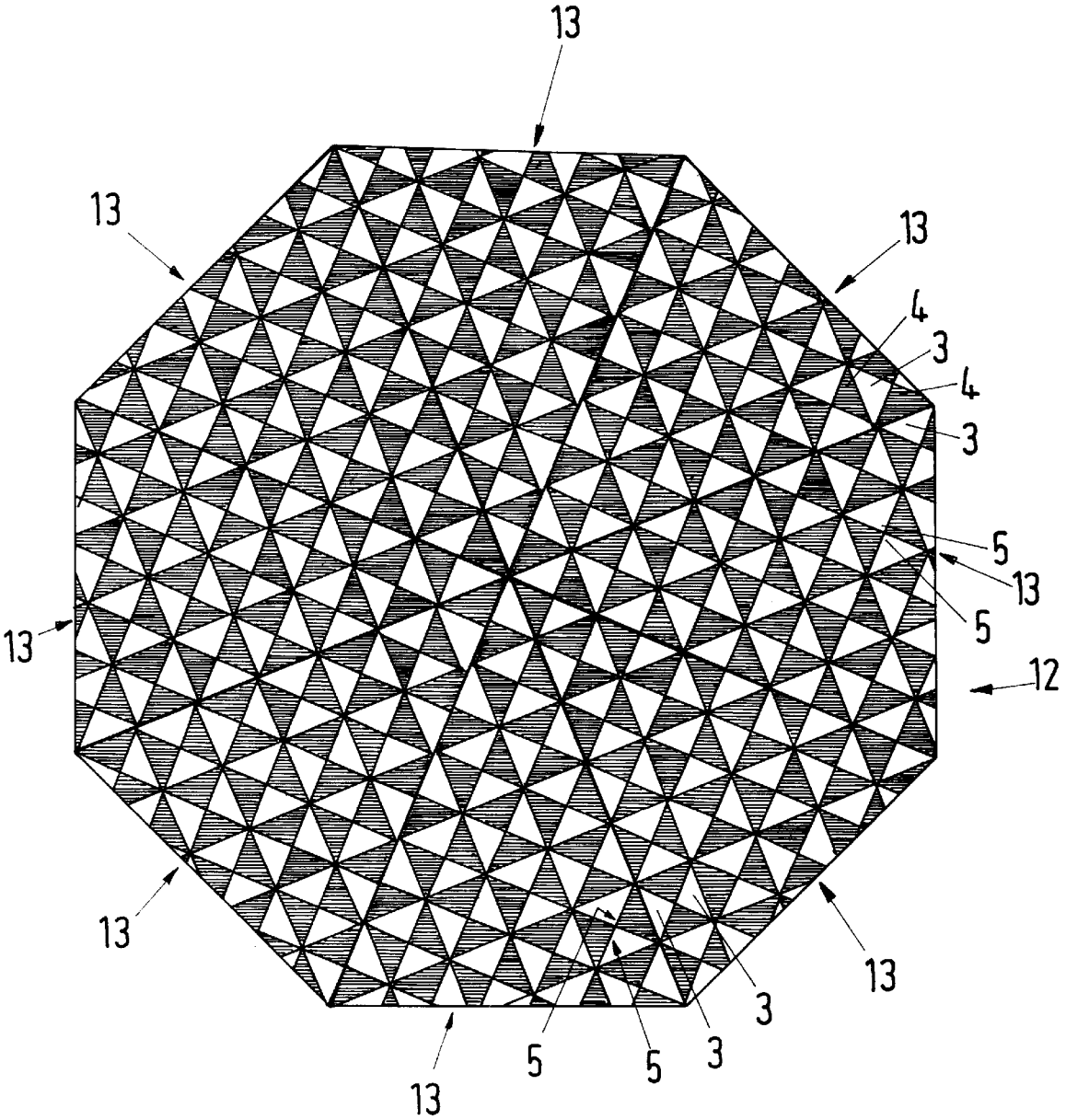
Figure 2:
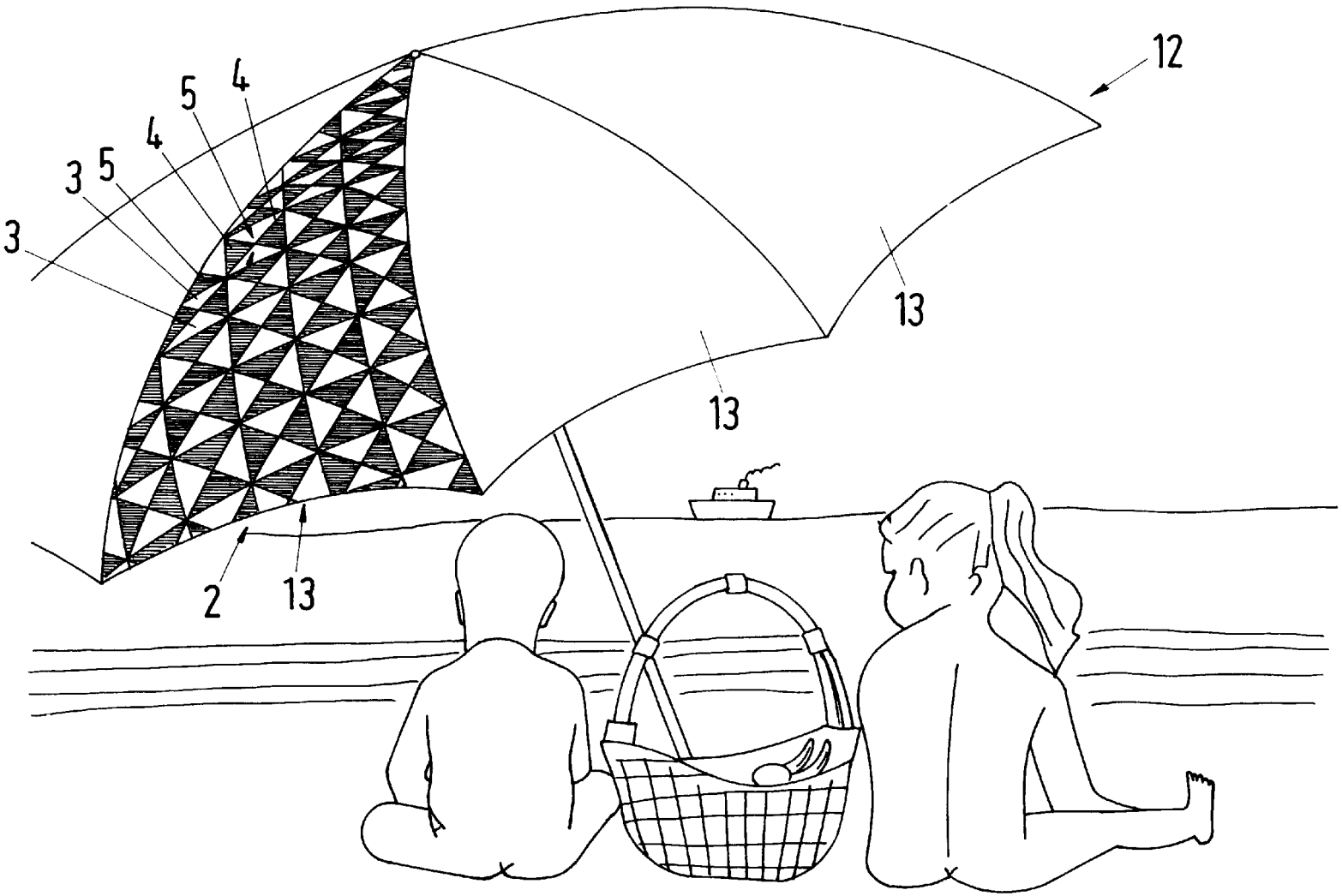

Such a pattern, as shown, for example, in FIG. 1, results when the light windows 3 and the barrier regions 4 form isosceles and right-angled triangles of equal size, in each case a light window 3 and a barrier region 4 adjoining one another over their hypotenuses and jointly forming a square.

In order to avoid the formation of light or shadow strips on the areas protected by the sunshade, the triangles of adjacent squares are offset from one another, the corner 5 of a light window 3, formed by the legs of equal length, being located opposite a similar corner 5 of a further light window 3.

Figure 7:
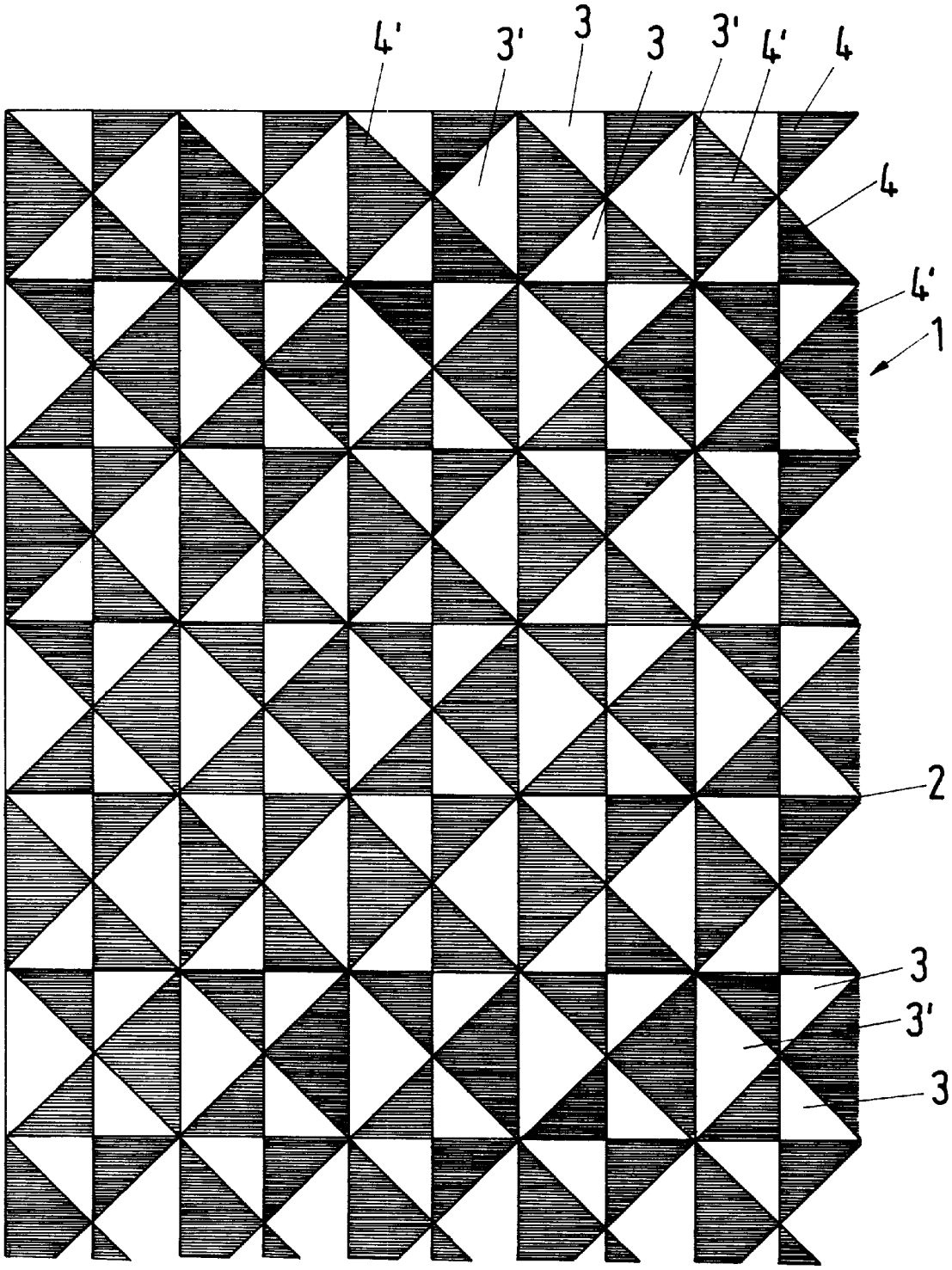

In FIG. 7, an alternative construction of a pattern of light windows 3 is shown, which also forms a triangular patter with a 50% transmission surface. However, the right-angled triangles adjoin here partially at their legs, as a result of which two such triangles are combined into a larger light window 3' or barrier region 4'.

The regions 2 of the sunshade 1, interspersed by light windows 3, have a network 6, which extends along the edges of the light windows 3 and the barrier regions 4 and divides the region 2 into individual, geometrically regular partial segments 7. These partial segments 7 may coincide with the above-mentioned squares, if light windows 3, as well as barrier regions 4, are developed within the partial segments 7 formed by the network 6. It is also possible that individual light windows 3 or individual barrier regions 4 extend over several partial segments formed by the network 6, in which case then the network 6 may be developed correspondingly tighter or the light windows 3 in each case are larger.

As mentioned above, the most advantageous longitudinal dimension for the light windows 3 or the barrier regions 4 is specified by the rate of travel of the sun, so that an excessive enlargement of the light windows 3 or the barrier regions 4 would be regarded as disadvantageous.

It is also possible that the partial segments 7, formed by the network 6, in each case form the boundary around precisely one light widow 3 or one barrier region 4.

The incorporation of a network as a support mechanism for a textile sunshade makes a high mechanical strength possible especially in the case of sunshades of large cons on.

Figure 3:
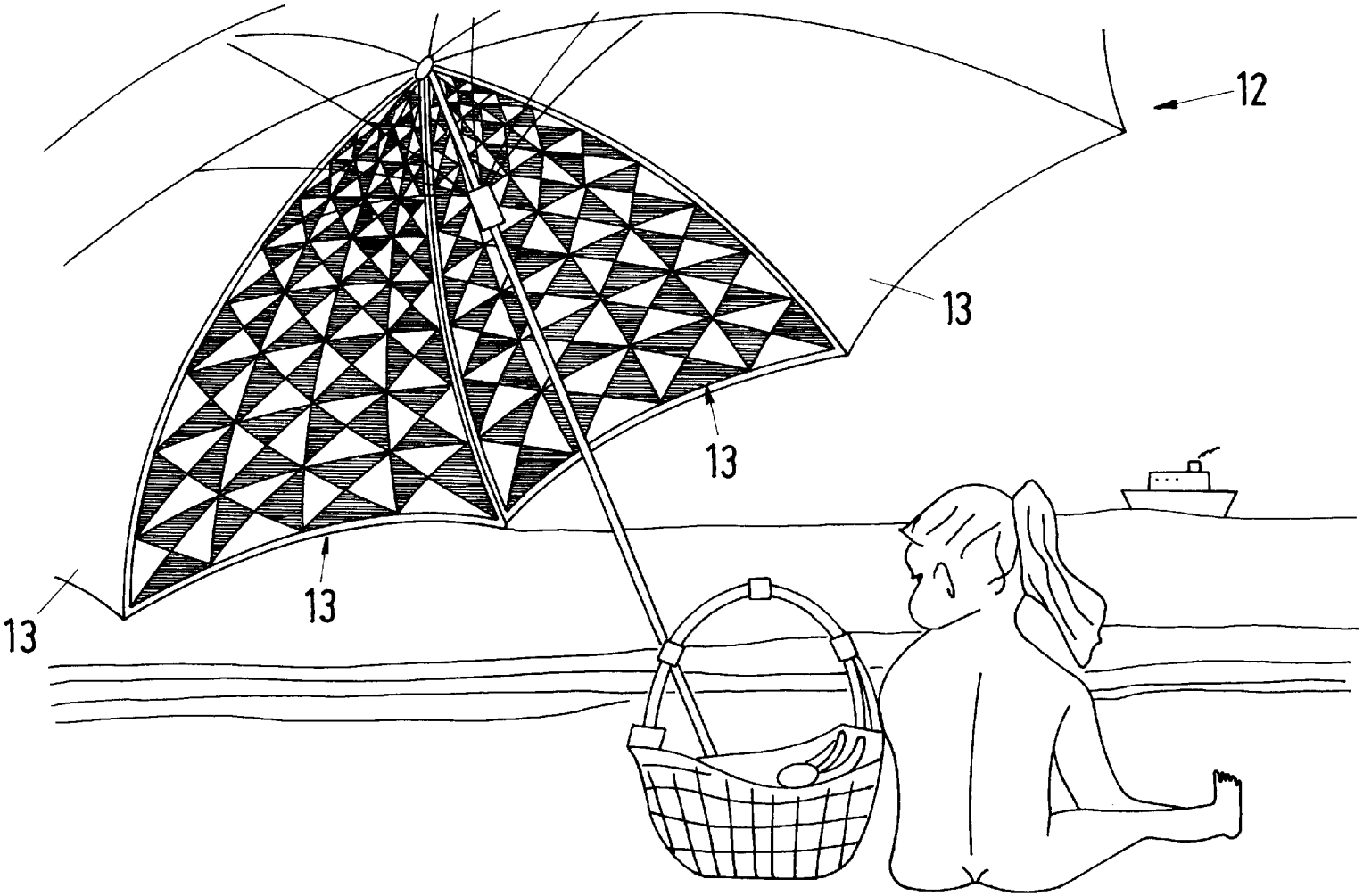
Figure 4:
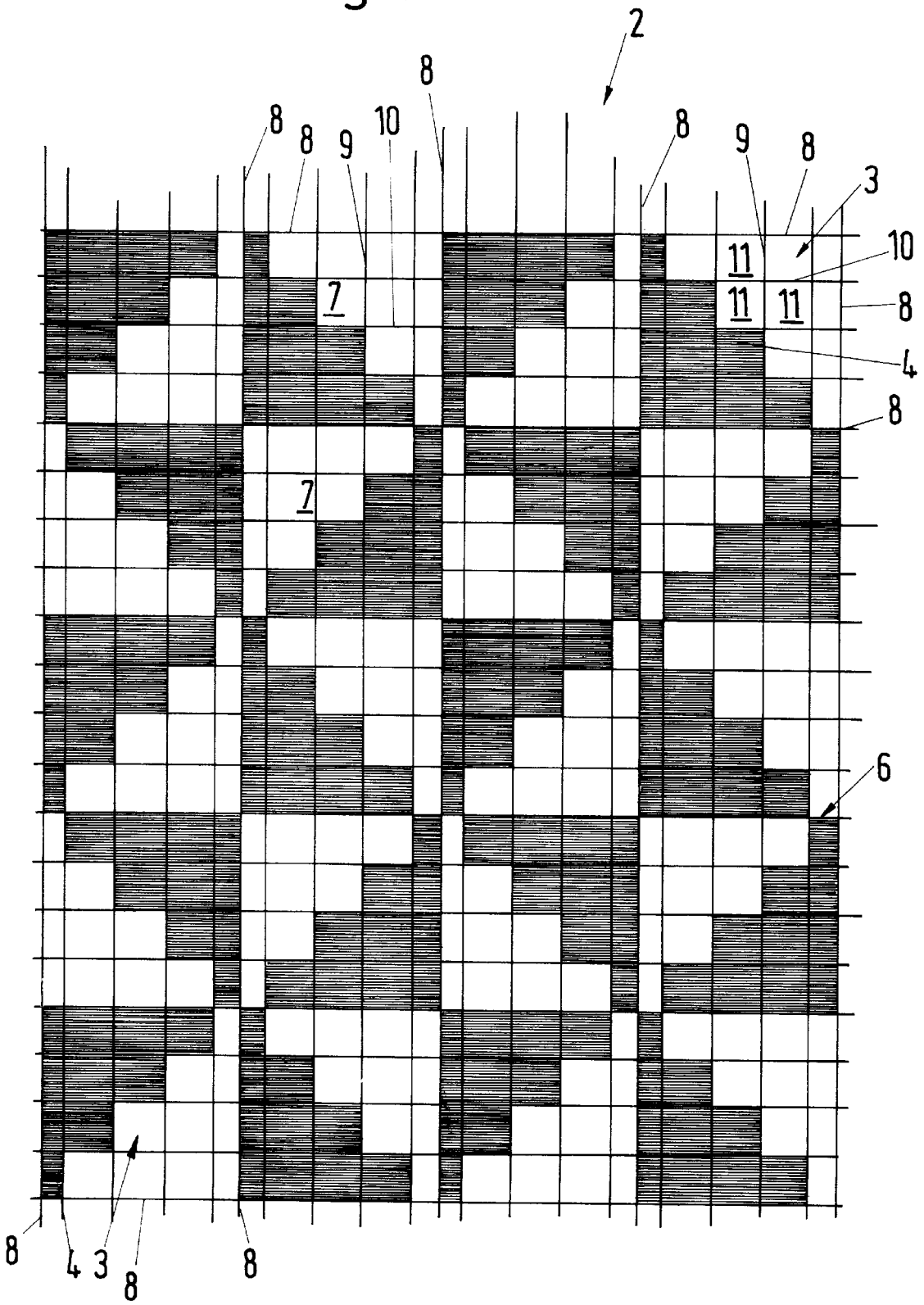
Figure 5:
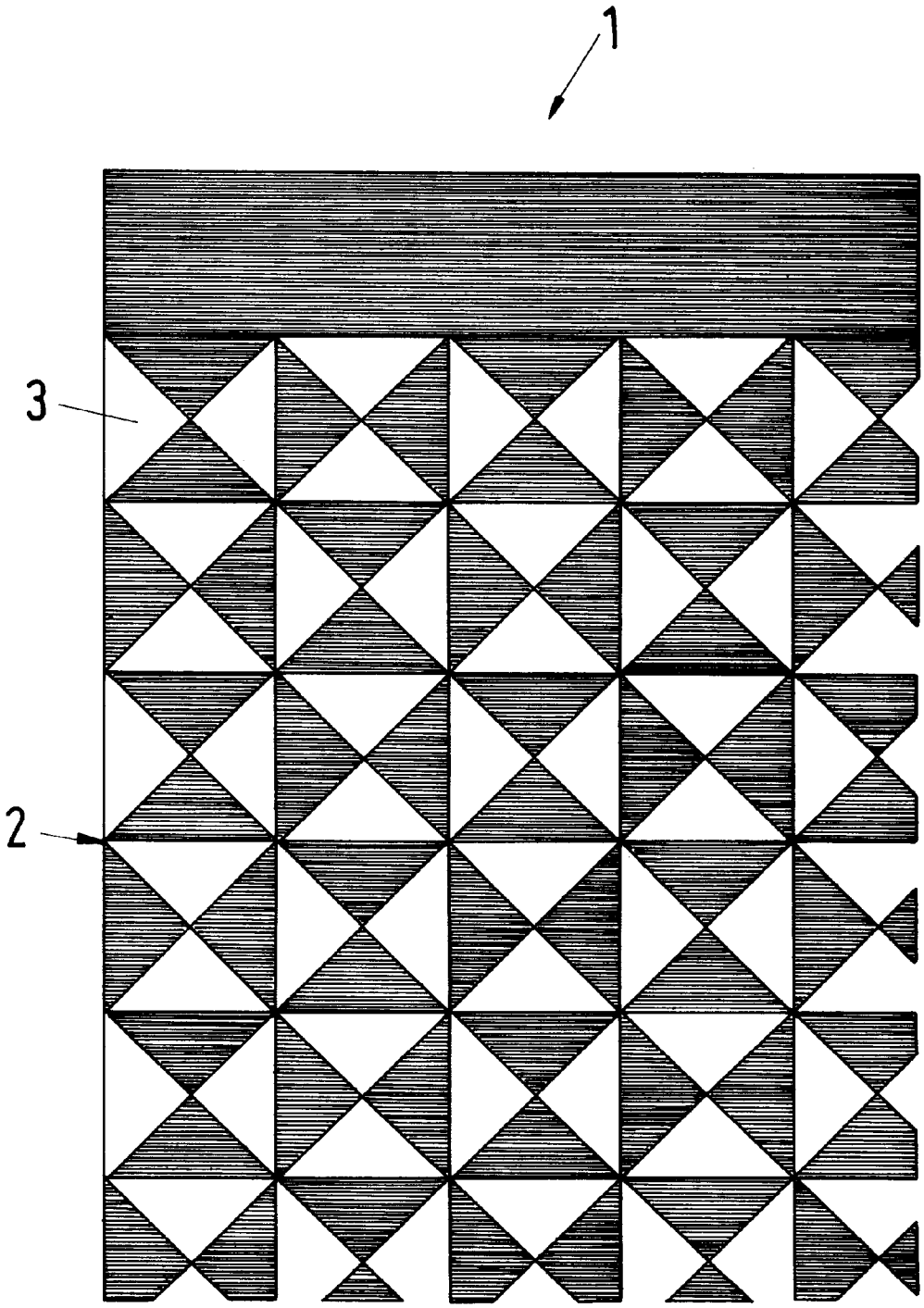

The light windows 3 need not have a uniform size but can, for example, in order to follow the shape of a sun umbrella segment, develop a possibly continuous size variation (FIG. 3).

In the present example, the supporting yarns 8 of the network 6 cross at right angles and are intertwined. The partial segments 7, formed by the crossed network yarns 8, form squares, which in turn are traversed by filling 9 and warp 10 yarns of a composite weave, these yarns 9, 10 dividing the partial segments 7 into smaller units 11 of area, which are also rectangular. These units 11 of area are filled partially with yarn-like material, such as polyacrylonitrile yarns, in order to achieve in this way a coverage of individual area region 11, so that the cove regions, all told, form a barrier region 4. Other area units 11 are left free, so that these, all told, form a light window 3. At the same time, in each case half of the area units 11 within a partial segment 7 are formed into a barrier region 4, the other half of these area units 11 remaining as open light windows 3.

The light windows 3 or barrier regions 4, formed from several adjacent area units 11, in each case have a triangular overall shape, a light window 3 being supplemented by a complementary barrier region 4 to form a complete partial segment 7, that is, in the present case a square, of the network 6. These two triangles, namely the light window 3 and the barrier region 4 are, as described above, right-angled, isosceles triangles, which adjoin at their hypotenuses, so that they jointly form a square.

As described above, these triangles of adjacent partial segments 7, formed approximately by squares, are mutually offset from one another, so that a continuous strip of light windows 3 or barrier regions 4 is prevented for each direction of sun insolation. Even if this solution, which is simple from a weaving point of view and cost effective, represents only an approximation of the desired, optimum, triangular shape of the light windows 3 or the barrier regions 4, the deviation from the optimum shape is not so serious that the embodiment, shown here, would not have the advantages mentioned.

A special advantage of the pattern shown arises especially when the sunshade 1 is constructed as an umbrella 12, because the whole of the umbrella can then be developed in one piece, without having to weave the individual sectors 13 of the umbrella separately and then having to sew them together. Instead, the pattern shown can be produced continuously over the whole of the covering of the umbrella; this reduces the manufacturing costs appreciably.

For producing the sunshade 1 from a plastic sheet, the light windows 3 can be formed as material recesses. However, they can also comprise, for example, a transparent plastic sheet, which in turn can have further radiation filters, so that the light windows 3 need not have a 100% transparency, for example, in the UV region.

Moreover, partial regions of the light windows 3 may be covered, for example, by tapes or yarns, which are moved by wind gusts and, by these means, bring about a partial shading of the light window 3.

Furthermore, it is possible to dispose several layers of a sunshade 1, which have different window sizes and/or shapes and preferably can be shifted relative to one another, on top of one another. The relative shifting of the layers results in a change in the size of the light windows 3. With that, it is possible, for example, to reduce the size of the light windows 3 uniformly over the whole area around noon, in order to permit the passage of, as far as possible, little radiation. As the day progresses, the light windows 3 can then be opened once again. Such a variability in the size and shape of the openings of the light windows can also be attained within one layer by having possibilities for closing the light windows 3, for example, in the form of closing flaps.

Because it can be closed off in such a manner, the sunshade 1 can be adapted to different requirements or closed off, in order to offer small children sufficient sun protection and opened, in order to permit a person to tan, aside from the tanning effect, the possibility of looking through the sunshade 1 also being provided at the same time by the light windows 3.

What is claimed is:

1. A sunshade comprising a material, at least sections of said material having a geometric pattern of substantially triangular light windows and substantially triangular barrier regions, the overall area of the light windows being substantially equal to the overall area of the barrier regions, whereby areas underlying the sunshade material are alternately exposed to sunlight and shade as the earth moves.

2. A sunshade according to claim 1 in which the sunshade is selected from the group consisting of an umbrella, an awning and a window shade.

3. A sunshade according to claim 1 wherein the barrier regions absorb the sunlight.

4. A sunshade according to claim 1 wherein the barrier regions reflect the sunlight.

5. A sunshade according to claim 1 wherein each of the substantially triangular light windows and each of the substantially triangular barrier regions are substantially congruent right angle isosceles triangles.

6. A sunshade according to claim 5 wherein the hypotenuse of each light window adjoins the hypotenuse of a juxtaposed barrier region to thereby form a plurality of substantially square areas.

7. A sunshade according to claim 6 wherein a plurality of said square areas are disposed juxtaposed to one another in linear array in which the hypotenuse of each square area in said plurality of square areas are coextensively and linearly aligned.

8. A sunshade according to claim 7 wherein each of said right angle isosceles triangles has two sides joined to each respective hypotenuse, one of said sides of each square area in said plurality of square areas being coextensively and linearly aligned.

9. A sunshade according to claim 8 wherein said linearly aligned hypotenuses define a first line and said linearly aligned sides define a second line, each of said first and second lines intersecting one another at an intersection.

10. A sunshade according to claim 9 wherein said first and second lines extend generally radially from said intersection.

11. A sunshade according to claim 10 wherein said first and second lines are disposed at acute angles relative to one another.

12. A sunshade according to claim 1 wherein two of said triangular light windows and two of said triangular barrier regions jointly form a square area.

13. A sunshade according to claim 1 wherein four of said triangular light windows and four of said barrier regions jointly form a square area.

14. A sunshade according to claim 1 wherein a first plurality of said triangular light windows are congruent right angle isosceles triangles having sides of a first length and a second plurality of said substantially triangular light windows are congruent right angle isosceles triangles having sides of a second length greater than said first length.

15. A sunshade according to claim 14 wherein the number of said first plurality of triangular light windows is substantially twice the number of said second plurality of triangular light windows.

16. A sunshade comprising a sunshade structure, at least sections of said sunshade structure including a geometric pattern of substantially triangular light windows and substantially triangular barrier regions, the overall area of the light windows being substantially equal to the overall area of the barrier regions, the sunshade structure including a support network which divides the sunshade structure into a plurality of segments in which each segment includes one of said substantially triangular light windows and one of said substantially triangular barrier regions.

17. A sunshade according to claim 16 wherein said support network is formed by elongated elements crossing at right angles.

18. A sunshade according to claim 17 wherein said segments of said support network each have a four sided polygonal configuration formed by said elongated elements crossing at right angles.

19. A sunshade according to claim 18 wherein said elongated elements crossing at right angles are interlaced.

20. A sunshade according to claim 16 wherein said segments of said support network are traversed by warp and filling yarns of a woven composite.

21. A sunshade according to claim 20 wherein said warp and filling yarns divide each segment into a plurality of smaller sub-areas.

22. A sunshade according to claim 21 wherein substantially one-half of said sub-areas in each segment form light windows and substantially one-half of said sub-areas in each segment form barrier regions.

23. A sunshade according to claim 21 wherein each of said sub-areas are substantially four-sided polygons.

24. A sunshade according to claim 16 wherein the sunshade is an umbrella formed from a one-piece woven fabric.

25. A sunshade according to claim 24 wherein the sunshade is an umbrella having a center and an outer periphery which form parts of a plurality of substantially triangular panels.

26. An umbrella comprising a material, at least sections of said material having a geometric pattern of substantially triangular light windows and substantially triangular barrier regions each of which are substantially congruent right angle isosceles triangles, the hypotenuse of each light window adjoining the hypotenuse of a juxtaposed barrier region to thereby form a plurality of square areas, a plurality of said square areas being disposed juxtaposed to one another in linear array in which the hypotenuse of each square area in said plurality of square areas are coextensively and linearly aligned, each of said right angle isosceles triangles having two sides joined to each respective hypotenuse, one of said sides of each square area in said plurality of linearly arrayed square areas being coextensively and linearly aligned, said linearly aligned hypotenuses defining a first line and said linearly aligned sides defining a second line, each of said first and second lines intersecting one another at an intersection, the umbrella having a center and an outer periphery, said center coinciding with said intersection, said first and second lines extending from said center to said outer periphery to define a substantially triangular panel of the umbrella, said umbrella including a plurality of said substantially triangular panels.

* * * * *